United States Patent [19]

Rose et al.

[11] Patent Number: 4,962,682

[45] Date of Patent: Oct. 16, 1990

[54] WRENCH EXTENSION AND SOCKET COUPLER

[76] Inventors: Stephen T. Rose; Tae-Woo Park, both of Lancaster, Calif.

[21] Appl. No.: 378,149

[22] Filed: Jul. 11, 1989

Related U.S. Application Data

[63] Continuation of Ser. No. 191,330, May 9, 1988, abandoned.

[51] Int. Cl.[5] ..... B25B 23/16

[52] U.S. Cl. ..... 81/177.85; 81/177.1

[58] Field of Search ..... 81/177.85, 177.1

[56] References Cited

U.S. PATENT DOCUMENTS 2,162,359 6/1939 Rhinevault ..... 81/177.85

3,208,318 9/1965 Roberts ..... 31/177.85

3,924,493 12/1975 Penner ..... 81/177.85

*Primary Examiner*—Frederick R. Schmidt

*Assistant Examiner*—Lawrence Cruz

*Attorney, Agent, or Firm*—Ellsworth R. Roston; Charles H. Schwartz

[57] ABSTRACT

A quick release coupler is disclosed herein for selectively joining the end of a wrench extension shaft and a socket which includes a resiliently mounted push button actuator carried on the shaft operably engageable by high and low points to hold or move a drive train between a lock and a release position with respect to a detent in the cavity of the socket. The drive train moves in a linear mode which is translated into a lateral movement so as to move in and out of locking relationship with the detent of the socket.

33 Claims, 1 Drawing Sheet

WRENCH EXTENSION AND SOCKET COUPLER

This is a continuation of application Ser. No. 191,330 filed May 9, 1988 now abandoned.

BACKGROUND OF THE INVENTION

1. Field of the Invention

The present invention relates to the field of quick release couplers and more particularly to a novel quick release means for interconnecting or coupling the end of a wrench extension shaft with a detented cavity in a socket so that the socket may be readily engaged or released with the shaft without removal or actuation of the wrench with respect to the extension shaft.

2. Brief Description of the Prior Art

In the past, it has been the conventional practice to connect extension shafts to ratchet wrenches by means of a quick disconnect means usually incorporating a lever for directionally engaging connecting means between the wrench and the shaft so that the shaft will rotate in a selected direction. Other means are provided, usually in the form of a ball and detent, which permits push button release of the extension shaft from the ratchet wrench. The push button release generally takes the form of a linear actuation of a plurality of balls arranged in a row so that the end ball will move in and out of connection with the detent in the end of the extension. Although such a construction is operable and useful for its intended purpose, no means are provided for quick release of the coupling between the end of the extension shaft and the socket itself. Therefore, in tight spaces where movement is extremely limited, it is difficult to attach and detach the socket from the end of the extension shaft with ease and convenience. Most couplings include a resilient ball which moves in and out of a detent; however, it is only with great force that the workman can pull the two pieces apart since no easy or quick release device is available.

Some attempts have been made to provide a quick release for the end of an extension rod or shaft with respect to a socket, such as disclosed in U.S. Pat. No. 3,924,493. However, such a device is complex and is difficult to manufacture since it requires insertion and assembly of a hairpin spring mechanism which includes installation of a steel ball constituting a detent serving as a fulcrum. Such a device is not only difficult to manufacture, assemble and use, but is readily rendered inoperative by accumulation of dirt or grease in the cavity through which the hairspring is moved.

Therefore, a long standing need has existed to provide a quick release mechanism for locking and unlocking a socket with respect to the end of an extension rod or shaft which is easy to assemble, convenient to manufacture, and which will not be rendered inoperable due to accumulation of dirt or foreign matter. Also, it is important that the release should be in a manner whereby lateral movement of a push button is translated into movement in a normal direction followed by lateral movement to effect release or lock.

SUMMARY OF THE INVENTION

Accordingly, the above problems and difficulties are obviated by the present invention which provides a novel quick release coupler for releasably joining a socket with the end of a wrench extension or rod which comprises a socket having an internal cavity open at one end and formed with a latching detent into which the end of a formed extension rod or shaft is inserted. The rod or shaft includes an elongated passageway connected at its opposite ends to lateral openings that open through the side of the shaft or rod. One opening serves to mount a resilient push button having high and low points, while the other opening serves to mount a latch in the form of a ball or sphere. The latch ball or sphere is held in position with respect to the detent in the socket when the actuating means is in its high position and released therefrom when the actuator is in its low position.

In one form of the invention, the motion translating means between the actuator and the latch may take the form of a series of balls arranged in end-to-end relationship within the passageway or in another form of the invention, the drive train may take the form of an elongated rod with rounded ends occupying the passageway.

Therefore, it is among the primary objects of the present invention to provide a novel push button release and locking mechanism for coupling a ratchet wrench extension rod with a socket that replaces the spring-loaded ball extension bars of all sizes.

Another object of the present invention is to provide a novel quick release coupler for joining the end of a wrench extension shaft or rod with a detented socket that permits the pushing of an actuator in one direction to operate a drive train in a direction perpendicular thereto for final translation into lateral movement of a latch in the same direction as the actuator.

Another object of the present invention is to provide a novel quick release mechanism for yieldably retaining the end of an extension shaft or rod with a socket that is relatively easy to manufacture and assemble and which will not be rendered inoperable when operated in an environment having dirt or foreign matter.

Yet another object of the present invention is to provide an improved extension shaft and socket connecting means which employs a push button quick release for spring-loaded socket-engaging latch and for a related extension shaft or rod for locking the socket thereto.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
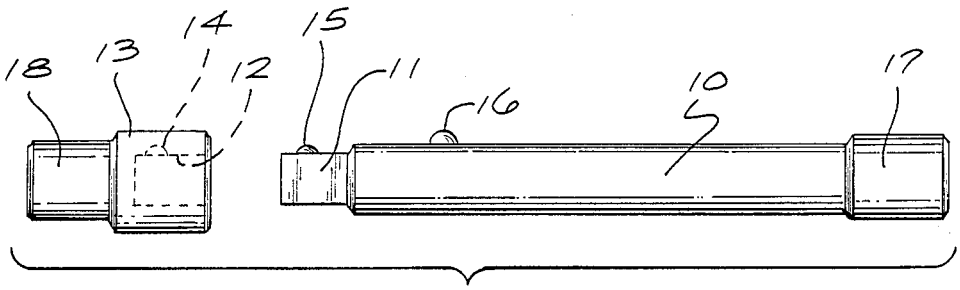
FIG. 1 is an exploded side elevational view illustrating a ratchet wrench extension rod or shaft preparatory for coupling with a socket incorporating the quick release means of the present invention.

Referring to FIG. 1, the novel quick release coupler of the present invention includes an elongated ratchet wrench extension shaft or rod 10 having a. hexigon-shaped end 11 adapted to be insertably received into a cavity 12 opening through one end of a socket 13. The cavity 12 includes a detent 14 into which a latch 15 is intended to be placed in order to lock the socket to the end 11 of the extension 10. An actuator 16 is employed for moving the latch 15 between its lock and unlock position with respect to the detent 14. As illustrated, the actuator 16 is outwardly disposed with respect to the external surface of the rod or shaft 10 and the latch 15 is similarly outwardly disposed. However, when the actuator 16 is depressed against a resilient bias, the latch 15 is released from its rigid position so as to disengage with the detent 14 for removal of the socket from the end 11.

The end of the extension 10 from its end 11 is provided with a socket 17 for receiving the ratchet mechanism from a typical ratchet wrench. However, it is to be understood that the wrench does not form a part of the present invention and that the coupling and quick release mechanism normally associated with either the rotating couplers or any of the rectilinear couplers used for joining wrenches with extension rods does not apply to the present invention. Also, it is to be understood that an end 18 of the socket 13 may include a shaped cavity intended to be insertably placed over a bolt or other fastening device intended to be tightened or untightened at the selection of the workman.

Figure 2:
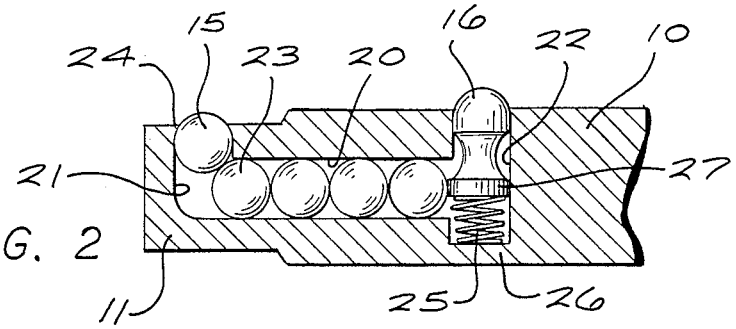
FIG. 2 is an enlarged cross-sectional view of the quick release mechanism used in the extension shaft or rod shown in FIG. 1 with the latch in its lock position.

Referring now in detail to FIG. 2, it can be seen that the end of the shaft or rod 10 is provided with an elongated internal passageway 20 having open ends terminating with lateral passageways 21 and 22 respectively. The longitudinal cavity 20 is substantially occupied by a plurality of balls or spheres, such as identified by numeral 23, that are adapted to move along the longitudinal axis of the shaft or rod 10. The latch 15 is represented by a sphere or ball having a portion thereof outwardly extending beyond the opening of the passageway 21 so as to enter into the detent 14 of the socket cavity 12 when the device or coupler is in its locking mode. The ball latch 15 cannot leave the lateral passageway 21 due to the fact that the opening of the passageway at the surface of the end 11 is reduced by means of an annular crimp 24 which permits only a portion of the latch ball 18 to protrude from the lateral passageway 21. The latch 15 is permitted to move back and forth within the lateral passageway 21 in response to the movement of the drive train made up of the plurality or multiplicity of balls 23. The actuator 16 is movably disposed within the passageway 22 so that a portion outwardly extends from the surface of the rod or shaft 10 in accordance with the bias of an expansion spring 25 carried at one end of the passageway 22. The spring is mounted against a shoulder 26 and bears against the underside of the actuator 16. The actuator 16 includes a high point indicated by the numeral 27 which, when in contact with the drive train made up of balls 23, forces the latch ball 15 to protrude from the end of lateral passageway 21 into the locked position. This is the normal biased position of the latch. However, when it is intended to release the latch 15 from the detent 14, the actuator is depressed as shown in FIG. 3.

Figure 3:
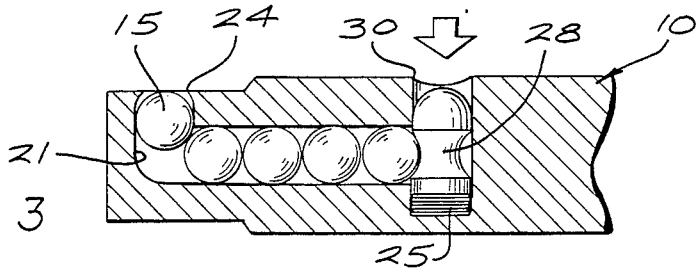
FIG. 3 is a view similar to the view of FIG. 2 illustrating the locking mechanism in its release position so that the latch is unlocked in response to depression of the actuator.

Referring now in detail to FIG. 3, it can be seen that depression of the latch 16 within the lateral passageway 22 against the expansion of spring 25 causes the low point 28 of the actuator 16 to relieve pressure on the plurality or series of balls 23 so that the balls move in the direction of the actuator, permitting withdrawal of the latch ball 15 into the lateral passageway 21 to effect unlocking of the latch with the detent. The actuator is manually depressed by the fingers or thumb of the user against the expansion of spring 25. A slight crimp of the opening leading into the lateral passageway 22 is illustrated by numeral 30 Which illustrates means for preventing the actuator from leaving the passageway under outward expansion of the spring 25.

Figure 4:
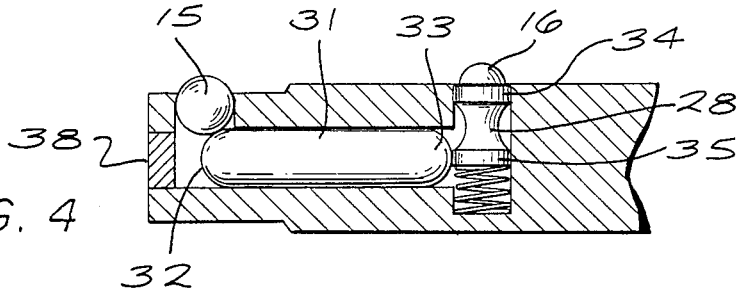
FIG. 4 is a longitudinal cross-sectional view of another embodiment incorporating the present invention.

Referring now in detail to FIG. 4, another means is provided for a drive train between the actuator and the latch which takes the form of an elongated rod 31 having rounded ends 32 and 33 adapted to engage with the latch 15 and actuator 16 accordingly. Also, the actuator is provided with a centering means so that the actuator will ride within the passageway 22 in a straight manner. Such a means includes a pair of shoulders 34 and 35 which ride against the walls of the passageway. During operation, the shoulder 35 may bear against the end of the rod 31. In either embodiment, the shoulder 34 or the shoulder 35 provides the high spot of the actuator while the reduction in diameter of the actuator for both versions is indicated by numeral 28.

Figure 5:
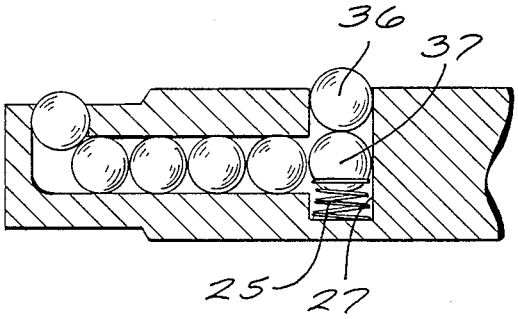
FIG. 5 is still another version of the present invention wherein the actuator takes the form of a pair of balls.

Referring now in detail to FIG. 5, another version of the invention is illustrated wherein the actuator 16 takes the form of a pair of spheres or balls, indicated by numerals 36 and 37, that are arranged in line within the lateral passageway 27. Spring bias is provided by the spring 25, as previously described, and the ball 37 will bear against the end of the ball train 23 or the rod 31 in order to actuate the latch.

Therefore, it can be seen that the novel release mechanism of the present invention provides a novel quick release for latching and unlatching the end of a ratchet wrench extension rod or shaft with respect to a socket. The lateral movement of the actuator is converted into longitudinal movement of the drive train followed by lateral movement of the latch in and out of the lock and unlock position. Such a movement and translation thereof is entirely different from the prior art with respect to quick release mechanisms for wrenches and socket extensions. In construction, the plurality of balls forming the drive train may be readily inserted through the interconnecting passageways followed by crimping of the opening to maintain the balls in position. However, with respect to the embodiment shown in FIG. 4, a plug is shown on the end of the passageway so as to permit the rod 31 to be inserted into passageway 22 during construction. The plug is indicated by numeral 38.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In combination for providing a quick coupling by a user to, and a decoupling by the user from, a socket with a cavity having a particular configuration and extending in a substantially axial direction and defining a detent at one position in the cavity, an extension shaft having an end extending in the particular direction with the particular configuration for mating with the cavity in the socket and having a fixed disposition relative to the socket in the substantially axial direction during a coupling of the shaft to the socket and a decoupling of the shaft from the socket, a first lateral passageway extending at least partially through the shaft, from a position external to the shaft, in a direction transverse to the substantially axial direction at a position beyond the cavity in the socket with the shaft in mating relationship with the cavity, the first lateral passageway communicating directly with the atmosphere, a second lateral passageway extending at least partially through the shaft in the transverse direction from a position external to the shaft and within the cavity in the socket with the shaft in mating relationship with the cavity, an internal passageway disposed in the shaft and extending substantially in the substantially axial direction and communicating with the first and second lateral passageways, first means disposed in the internal passageway and variably positioned substantially axially in the internal passageway, the variable positioning of the first means occurring in accordance with the depression or release of depressible means, and second means variably disposed in the second lateral passageway, said depressible means being disposed in the first lateral passageway and projecting externally from the first lateral passageway to a position communicating directly with the atmosphere for direct manual contact by the user and having means for cooperating with a portion of said first means when said depressible means is depressed, enabling disposition of said second means toward said internal passageway for coupling and decoupling said socket.

2. In a combination as set forth in claim 1, a member for biasing the depressible means in the transverse direction in the first lateral passageway to the undepressed position, the second means being variably disposed in the second lateral passageway without any constraint against movement in the second lateral passageway other than that provided by the first means and the biasing member.

3. In a combination as set forth in claim 2, there being only a single biasing member, the biasing member constituting a single helical spring disposed in the first lateral passageway to bias the depressible means in the transverse direction in the first lateral passageway to the undepressed position, the second means constituting a latch, and the shaft being constructed to retain the latch in the second lateral passageway in the engaged and disengaged relationship of the latch with the detent in the cavity of the socket.

4. In a combination as set forth in claim 2, the depressible means constituting a plurality of balls, the depressible means and the second means being movable in the same vectorial direction.

5. In a combination as set forth in claim 2, the depressible means constituting a manually actuatable member, a first means constituting an elongated rod, the depressible means and the second means being movable in the same vectorial direction.

6. In a combination as set forth in claim 2, the depressible means constituting a plurality of balls, the depressible means and the second means being movable in the same vectorial direction.

7. In combination for providing a quick coupling by a user to, and a decoupling by the user from, a socket with a cavity having a particular configuration and extending in a substantially axial direction and defining a detent at one position in the cavity, an extension shaft having the particular configuration at one end for mating disposition in the cavity with the socket and having a fixed disposition relative to the socket in the particular direction during a coupling of the shaft to the socket and a decoupling of the shaft from the socket, a first lateral passageway in the shaft at a position where the shaft has the particular configuration, the first lateral passageway extending at one end to a position external to the shaft, a latch disposed in the first lateral passageway for disposition in one position in the detent in the socket cavity, a second lateral passageway in the shaft, the second lateral passageway being displaced from the socket with the shaft in mating relationship with the cavity in the socket, the second lateral passageway extending at one end to a position external to the shaft and communicating directly with the atmosphere, an internal passageway disposed in the shaft in the substantially axial direction in communication with the first and second lateral passageways, and coupling means disposed in the internal passageway in co-operative relationship with the latch and depressible means and movable substantially axially in the internal passageway, the movement of the coupling means occurring in accordance with the depression or release of depressible means, the depressible means being disposed in the second lateral passageway, the depressible means being disposed for direct manual contact by the user and being directly engaged by the user for manual depression by the user from a position external of the shaft to move in the second lateral passageway from an undepressed position to a depressed position, the depressible means including means for cooperating with a portion of the coupling means when the depressible means is depressed, enabling disposition of the latch toward the internal passageway for coupling and decoupling the socket.

8. In a combination as recited in claim 7, a resiliently compressible member disposed in one of the passageways for acting upon the depressible means to dispose the depressible means in the undepressed position, the latch being disposed in the first lateral passageway without any constraint against movement in the first lateral passageway other than that provided by the coupling means and the resiliently compressible member.

9. In a combination as set forth in claim 8, there being only one resiliently compressible member in the combination, the resiliently compressible member constituting a spring, the spring constituting the only spring in the combination.

10. In a combination as set forth in claim 8, the first and second lateral passageways being substantially parallel and the internal passageway extending in a direction substantially perpendicular to the first and second lateral passageways.

11. In a combination as set forth in claim 10, the coupling means constituting an elongated rod, the depressible means constituting an actuatable member constructed to provide for a displacement of the rod in the substantially axial direction in the internal passageway upon the depression of the actuable member and to provide for a movement of the latch, simultaneously with the movement of the coupling means, relative to the detent in the socket cavity to a position disengaging the latch from such detent.

12. In a combination as set forth in claim 10, the coupling means constituting at least one ball, the depressible means constituting an actuatable member constructed to provide for a displacement of the ball in the substantially axial direction in the internal passageway upon the depression of the actuatable member and to provide for a movement of the latch, simultaneously with the movement of the coupling means, relative to the detent in the socket cavity to a position disengaging the latch from such detent.

13. In a combination as set forth in claim 10, the coupling means constituting a first ball, the depressible means constituting at least a second ball constructed and disposed to provide for a displacement of the first ball in the substantially axial direction in the internal passageway upon the depression of the second ball and to provide for a movement of the latch, simultaneously with the movement of the coupling means, relative to the detent in the socket casing to a position disengaging the latch from such detent.

14. In a combination as recited in claim 7, the shaft being constructed at the first lateral passageway to retain the latch in the first lateral passageway.

15. In combination for providing a quick coupling by a user to, and a decoupling by the user from, a socket with a cavity having a particular configuration and extending in a substantially axial direction and defining a detent at one position in the cavity, an extension shaft configured at one end to be disposed in the cavity and to mate with the socket when disposed in the cavity, the extension shaft having a fixed disposition relative to the socket in the substantially axial direction during a coupling to the socket and a decoupling from the socket, a first passageway disposed in the shaft at a position for disposition within the cavity in the socket when the shaft mates with the socket, the first passageway extending from a position external to the shaft, a latch disposed within the first passageway, a second passageway disposed in the shaft at a position displaced on the shaft from the first passageway for disposition outside of the cavity in the socket when the shaft mates with the socket, the second passageway extending in substantially the same direction as the first passageway, the second passageway extending from a position external to the shaft and communicating directly with the atmosphere, an internal passageway disposed within the shaft in the substantially axial direction and communicating with the first and second passageways, and coupling means variably disposed in the particular direction within the internal passageway in cooperative relationship with the latch and depressible means and movable substantially axially within the internal passageway, the depressible means being disposed within the second passageway at a position communicating directly with the atmosphere for direct contact by the user from a position external to the shaft and for manual depression by the user, the depressible means including means for cooperating with a portion of the coupling means when said depressible means is depressed, enabling disposition of the latch toward the internal passageway for coupling and decoupling the shaft.

16. In a combination as recited in claim 15, a member disposed within one of the passageways for biasing the depressible means to the undepressed position, the latch being disposed in the first passageway without any constraint against movement in the first passageway other than that provided by the coupling means and the biasing member.

17. In a combination as set forth in claim 16, the biasing member for the depressible means constituting the only biasing member in the combination, the depressible means being constructed and disposed relative to the coupling means to provide for a displacement of the coupling means substantially axially the internal passageway relative to the depressible means upon the depression of the depressible means as a result of the direct contact by the user, and the latch being progressively displaced from the detent in the cavity in the socket during the progressive displacement of the coupling means in the particular direction in the internal passageway relative to the depressible means upon the depression of the depressible means as a result of the direct contact by the user.

18. In a combination as set forth in claim 16, the first and second passageways being disposed in the shaft in a direction substantially perpendicular to the particular direction, and the biasing member being disposed within only one of the first and second passageways for biasing the depressible means to the undepressed position.

19. In a combination as set forth in claim 16, the biasing member for the depressible means being disposed in the second passageway, and the depressible means and the latch being movable in the same vectorial direction.

20. In a combination as set forth in claim 19, the first passageway being constructed to retain the latch within the first passageway.

21. In a combination as set forth in claim 20, the depressible means constituting an actuable member, the biasing member constituting a spring, the coupling means constituting an elongated rod.

22. In a combination as set forth in claim 20, the depressible means constituting an actuable member, the biasing member constituting a spring, the coupling means constituting at least one ball.

23. In a combination as set forth in claim 20, the depressible means constituting at least a first ball, the biasing member constituting a spring, the coupling means constituting at least a second ball.

24. In combination for providing a quick coupling by a user to, and a decoupling by the user from, a socket with a cavity having a particular configuration and extending in a substantially axial direction and defining a detent at one position in the cavity, an extension shaft extending in the substantially axial direction and having the particular configuration at one end for mating with the socket when the shaft is inserted into the cavity, the extension having a fixed disposition relative to the socket during a coupling to the socket and a decoupling from the socket, a first passageway extending, in a direction transverse to the substantially axial direction, from a position external to the shaft at a position within the cavity with the shaft and the cavity in the mating relationship, a second passageway extending in the transverse direction from a position external to the shaft at a position out of the cavity with the shaft and the socket in the mating relationship, the second passageway being exposed directly to the atmosphere and communicating directly with the atmosphere, a latch disposed in the first passageway, the first passageway being constructed to retain the latch in the first passageway, actuatable means disposed in the second passageway and extending externally from the second passageway to the atmosphere for direct contact by the user to provide for the manual actuation by the user from an undepressed position to a depressed position, a third passageway disposed within the shaft in communicating relationship with the first and second passageways, a member disposed in one of the passageways for biasing the actuatable means to the undepressed position in the second passageway, coupling means disposed in the third passageway in cooperative relationship with the latch and the actuable means and variably positioned substantially axially in the third passageway, the latch being disposed relative to the detent to be engaged by the detent with the actuable means in the undepressed position, the latch being disposed in the first passageway without any constraint against movement along the first passageway other than that provided by the coupling means and the biasing member, the actuatable means including means for cooperating with a portion of the coupling means when the actuatable means is actuated, enabling disposition of the latch toward the third passageway for coupling and decoupling the socket.

25. In a combination as set forth in claim 24, the biasing member constituting a spring and the biasing member constituting the only spring in the combination.

26. In a combination as set forth in claim 25, the first and second passageways being substantially perpendicular to the particular direction.

27. In a combination as set forth in claim 24, the actuatable means being constructed at a position displaced from the third passageway in the undepressed position of the actuatable means to engage the coupling means and being operable, upon the depression of the actuatable means, to provide for a simultaneous movement of the coupling means in the particular direction in the third passageway and the latch out of the detent in the socket.

28. In a combination as set forth in claim 25, the actuatable means constituting an actuatable member.

29. In a combination as set forth in claim 25, the actuatable means constituting at least one ball.

30. In a combination as recited in claim 28, the coupling means constituting an elongated rod.

31. In a combination as recited in claim 29, the coupling means constituting at least a second ball.

32. In a combination as set forth in claim 28, the coupling means constituting at least one ball.

33. In a combination as set forth in claim 29, the coupling means constituting an elongated rod.

* * * * *